US005658141A

United States Patent [19]

Larquet et al.

[11] Patent Number: 5,658,141

[45] Date of Patent: Aug. 19, 1997

[54] DEVICE FOR SPREADING A FLAME BY THE COANDA EFFECT

[75] Inventors: Christian Larquet, Guyancourt; Alain Villermet, Viroflay, both of France

[73] Assignee: L'Air Liquide, Societe Anonyme Pour L'Etude et L'Exploitation des Procedes Georges Claude, Paris Cedex, France

[21] Appl. No.: 518,282

[22] Filed: Aug. 23, 1995

[30] Foreign Application Priority Data

Sep. 7, 1994 [FR] France ..... 94 10704

[51] Int. Cl.[6] ..... F23C 7/00

[52] U.S. Cl. ..... 431/187; 431/348; 239/DIG. 7; 239/424

[58] Field of Search ..... 431/187, 188, 431/181, 348; 239/DIG. 7, 423, 424

[56] References Cited

U.S. PATENT DOCUMENTS

| | | | |
|---|---|---|---|
| 3,133,731 | 5/1964 | Reed | 431/187 |
| 3,836,315 | 9/1974 | Shular | 431/188 |
| 4,146,357 | 3/1979 | Ward et al. . | |
| 4,246,236 | 1/1981 | Di Gioachino et al. | 431/187 |
| 4,336,017 | 6/1982 | Desty | 239/DIG. 7 |
| 5,110,285 | 5/1992 | Snyder et al. . | |

FOREIGN PATENT DOCUMENTS

| | | | |
|---|---|---|---|
| 1026006 | 1/1989 | Japan . | |
| 779737 | 11/1980 | U.S.S.R. | 431/348 |
| 2253576 | 9/1992 | United Kingdom . | |

*Primary Examiner*—Carroll B. Dority
*Attorney, Agent, or Firm*—Young & Thompson

[57] ABSTRACT

A device for spreading a flame, comprises at least one principal nozzle (35) delivering a jet of combustible gas or combustion supporting gas (6); at least one secondary nozzle (8) delivering a jet of combustion supporting gas or combustible gas (12) which flows next to the principal jet and which has a substantially constant thickness. At least one curved surface (9) is disposed tangentially to the jet of secondary gas so as to deflect it by the Coanda effect, to draw in the principal jet of gas (6) and to mix the gas of the secondary jet (12) and the gas of the principal jet (6) to form a flame.

11 Claims, 5 Drawing Sheets

DEVICE FOR SPREADING A FLAME BY THE COANDA EFFECT

The invention relates to a device for spreading a flame by the Coanda effect.

In numerous fields, particularly industry, there is used the heat of a flame obtained by the mixture and combustion of a combustible gas and a combustion supporting gas. So as to distribute the heat of the flame, devices for spreading the flame have already been devised.

There are known for example heating nozzles comprising a central tube which delivers a combustible gas and an annular tube, surrounding the central tube, which delivers a combustion supporting gas. It is known to place an obstacle in the form of a cone in the path of the jet of combustible gas so as to enlarge it. The annular jet of combustion supporting gas is entrained by the combustible gas, which forms a widened flame.

It is also known to position a metallic member in the shape of a reversed funnel at the outlet of the nozzle of the jet of combustion supporting gas. This requires the flame to follow this member and hence to widen. However, the heat transfer from the flame to the metallic member is very great. This solution is therefore very difficult to practice.

However, the assembly of flame-spreading devices known at present does not permit obtaining a flat flame, which is to say a flame very much widened whose height is small.

The present invention has for its object a device for spreading a flame which permits achieving this result.

To this end, the device according to the invention comprises:

- at least one principal nozzle delivering a jet of combustible gas or of combustion supporting gas;
- at least one secondary nozzle delivering a jet of combustion supporting gas or combustible gas which flows around the principal jet and which has a substantially constant thickness;
- at least one curved surface disposed tangentially to the secondary jet of gas so as to deflect it by the Coanda effect, to draw in the principal jet of gas and to mix the secondary jet of gas and the principal jet of gas to form a flame.

Thanks to this arrangement there is obtained an excellent mixture of the combustible gas and the combustion supporting gas because of the difference of speed between the two jets and of the turbulent flow which results therefrom.

Another advantage of this device is that it gives a very high stability to the spread flame. Moreover, the obtained spread flame follows perfectly the curved surface, which permits obtaining a very flat flame and hence an excellent distribution of the heat which it produces.

The cross section of the principal nozzle and the cross section of the secondary nozzle can naturally have quite various shapes.

In a current embodiment, the principal nozzle has a circular cross section and the secondary nozzle, of annular cross section, surrounds the principal nozzle.

According to another current embodiment, the principal nozzle is of rectangular shape, at least one secondary nozzle delivering a secondary jet tangential to one of the sides of the rectangle formed by the cross section of the principal nozzle. The principal nozzle can also have other very different shapes, for example square, polygonal, polygonal with rounded corners, ellipsoidal or ovoidal, etc. . . .

Various combustible gases can be used, for example methane or propane or any hydrocarbon.

The combustion supporting gas is preferably oxygen, but this can also be air.

The invention also relates to a furnace comprising a wall delimiting a chamber and heating means.

There are already known furnaces comprising a refractory wall heated by a flame. The refractory wall then heats the internal atmosphere of the furnace and the charge contained in the furnace. So as to ensure the best possible distribution of the heat, there are used devices for spreading the flame.

However, these devices do not permit obtaining a perfectly flat flame.

This problem is solved according to the present invention, by the fact that the heating means which are provided in the furnace are constituted by:

- at least one principal nozzle delivering a jet of combustible gas or of combustion supporting gas;
- at least one secondary nozzle delivering a jet of combustion supporting gas or combustible gas which flows about the principal jet and which has a substantially constant thickness;
- at least one curved surface disposed tangentially to the secondary jet of gas so as to deflect it by the Coanda effect, to draw in the principal jet of gas and to mix the secondary jet of gas and the principal jet of gas to form a flame.

In one embodiment of the furnace, the principal jet is substantially perpendicular to a wall of the furnace, and the curved surface deflects the jet substantially by 90° such that the flame flows tangentially to a wall of the furnace.

This embodiment permits widening the flame which becomes totally flat and heating the refractory wall of the furnace. There is thus obtained a very good diffusion of the heat. This embodiment is applicable advantageously to small size furnaces in which the flame should not reach the charge to be heated.

There are also known other types of furnaces in which it is desired to obtain a thin flame. It can be desired in this case that the flame remain parallel to the surface of the bath and have as constant a thickness as possible so as to ensure regular and homogeneous heating of the bath.

This problem is solved according to the present invention by the fact that the curved surface ends in a region substantially perpendicular to the wall of the furnace so as to obtain a flame perpendicular to this wall.

Thanks to this characteristic there is obtained a thin flame whose orientation can be controlled. There is thus obtained a thin flame whose distance to a charge can be maintained constant.

In one embodiment, the region substantially perpendicular to the wall of the furnace is disposed horizontally.

In another embodiment, the region substantially perpendicular to the wall of the furnace is disposed vertically.

Other characteristics and advantages of the present invention will become apparent from a reading of the detailed description which follows for the understanding of which reference will be had to the accompanying drawings in which.

Figure 1:
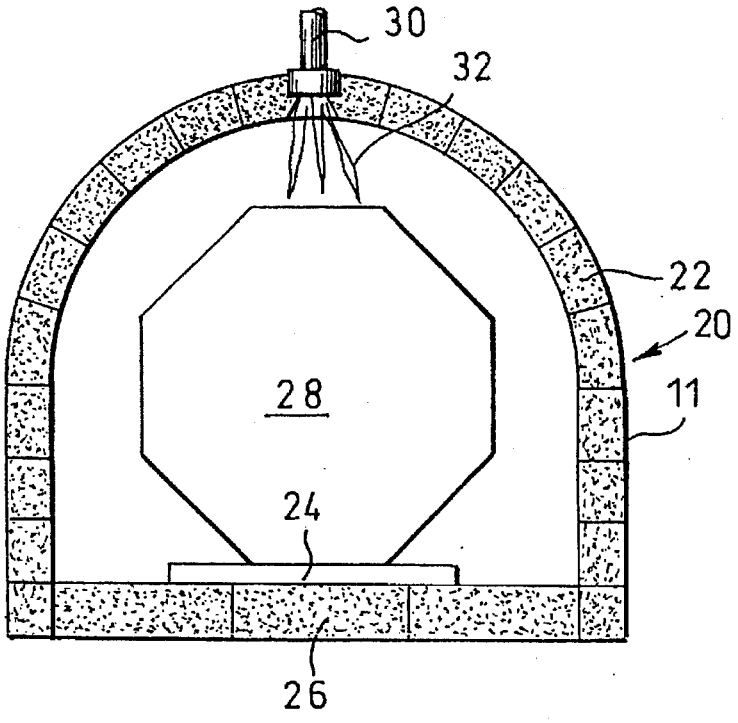
FIG.1 PRIOR ART
FIG. 1 is a cross-sectional view of a furnace of known type.

The Coanda effect is a known phenomenon in which a jet flow remains attached to a tangential surface over which it flows. The jet remains attached to the tangential surface even if this latter progressively diverges from its initial position by a certain angle. This effect will be explained with reference to FIG. 3, which shows the principle of a flame-spreading device according to the invention.

The device comprises a principal nozzle 4 adapted to deliver a gas, for example a combustible gas. The end of the nozzle 4 is located in a hole formed in a thick wall. The principal jet, whose flow is shown schematically by arrows 6, flows parallel to a curved wall 10 formed by the thick wall.

The secondary nozzle 8 is constituted by the space comprised between the principal nozzle 4 and the curved surface 10. The secondary jet 12, for example of combustion supporting gas, flows tangentially to the walls 10 and to the outlet of the secondary nozzle 8. The space comprised between the exterior of the principal nozzle 4 and the wall 10 has a substantially constant cross section and is of small size, for example 0.3 mm.

Figure 3:
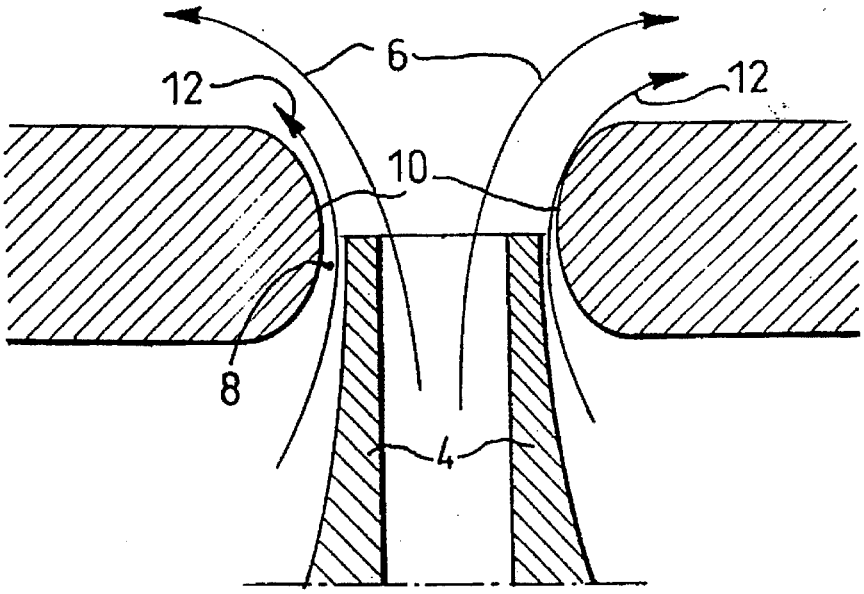
FIG. 3 is a schematic cross-sectional view which shows the operation of a flame-spreading device according to the invention.

When the principal jet is alone, it leaves the nozzle substantially vertically (with regard to the orientation of FIG. 3).

When the secondary jet 12 is alone, it flows tangentially to the wall 10 by the Coanda effect. This wall is curved and progressively diverges to form an angle of 90° relative to the axis of the principal and secondary nozzles. The secondary jet, also called a parietal jet because it flows along the wall 10, produces a strong vacuum in the central region into which opens the principal nozzle 4.

When the two jets, namely the principal jet and the secondary jet (or parietal jet) flow simultaneously, the parietal jet whose speed of flow is substantially greater than that of the principal jet, draws in this latter. The two jets mix and the resulting jet flows horizontally. The vacuum created by the Coanda effect within the parietal jet in the region of curvature is such that all the principal jet is entrained by the parietal jet to follow the wall 10. The equilibrium of the spread jet is perfectly stable over a range of speed of the parietal jet relative to the principal jet and it is not possible to upset this equilibrium.

The stream of primary gas, for example combustible gas, mixes rapidly with the stream of secondary gas, for example combustion supporting gas, to form a combustible mixture which gives rise to the flame.

There is shown in FIG. 1 a cross section of a furnace of the prior art, generally shown at 20. This furnace comprises an external wall 11 of steel and an internal wall 22 lined with bricks of refractory material. A hearth 24 is disposed on the bottom 26 of the furnace. A metallic member 28 to be heated, for example a steel ingot, rests on the hearth 24.

At its upper portion the furnace 20 comprises heating means 30 which deliver a flame 32. It is known to use devices for spreading the flame so as to obtain a flame as wide and flat as possible so as to distribute the heat of this flame and to heat the member 28 in a homogeneous manner. This result cannot be achieved easily with flame-spreading devices known at present.

Figure 4:
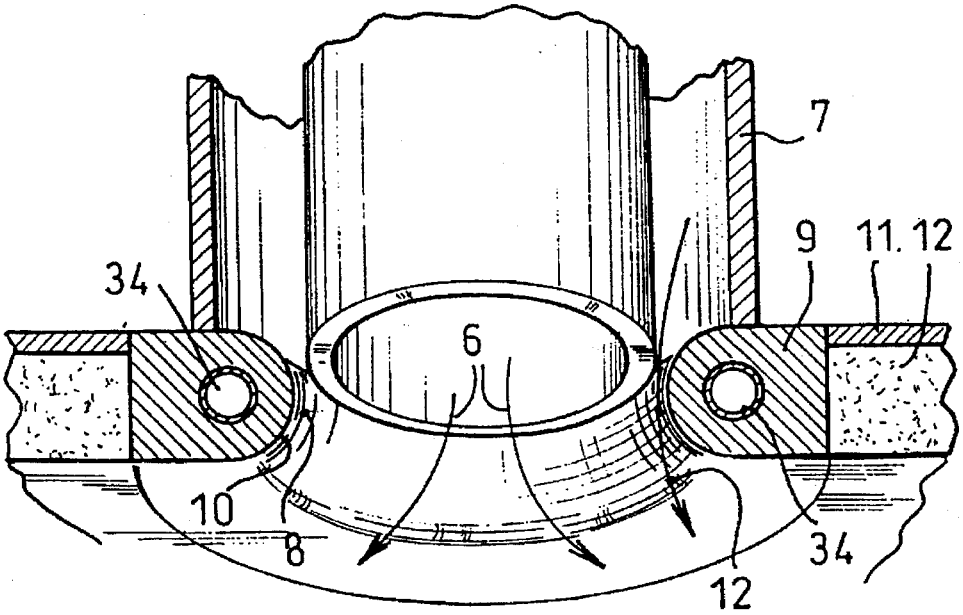
FIG. 4 is a perspective view of a device for spreading flame according to the invention, comprising principal and secondary nozzles of circular cross section.

There is shown in FIG. 4 heating means which are provided in a furnace according to the present invention.

These heating means are constituted by a tube 4 of circular cross section which constitutes a principal nozzle. The tube 4 is surrounded by a tube 7 also of circular cross section. This tube 7 is connected to a toric member 9. The end of the tube 4 opens substantially in the middle of the thickness of the member 9. The member 9 is inserted in the vault of the furnace at the position of the heating means 30 shown in FIG. 1. It comprises a curved surface 10.

The external wall of the furnace is constituted by a steel plate 11 lined internally with refractory bricks 22.

The principal nozzle 4 delivers a jet of combustible gas.

A combustion supporting gas is supplied within the annular space 8 comprised between the tube 4 and the tube 7.

An annular passage of small width is comprised between the external surface of the member 9 and the external diameter of the tube 4. The typical dimension of this space is comprised between 0.2 mm and 1 mm, but can have other values. This permits giving to the secondary jet a speed of flow much higher than that of the principal jet 6.

A channel 34 in which circulates a cooling fluid such as water ensures cooling of the member 9.

The operation of these heating means is identical to that explained with reference to FIG. 3. In other words, the flame which results from the mixture of combustible gas 6 and of combustion supporting gas 12 follows the curved surface of the member 9 and then flows along the refractory bricks 22, substantially parallel to these latter. Under these conditions, the flame essentially heats the refractory bricks which thus ensures a distribution of the heat by radiation. It will accordingly be possible to obtain a very homogeneous heating of a charge such as the member 28.

It is not necessary that the combustible gas flow through the principal nozzle and the combustion supporting gas through the secondary nozzle. An identical result will be obtained by delivering the combustion supporting gas through the tube 4 constituting the principal nozzle and supplying the combustible gas into the annular space comprised between the tube 4 and the tube 7.

The member 28 to be heated is not touched by the flames because these latter flow along the wall. This characteristic is advantageous particularly in the case of a small furnace.

There has been built a furnace whose walls lined with refractory material comprise principal circular nozzles of 20 mm diameter. The annular space comprised between the exterior of the principal nozzle and the tangent wall of the member 9 was 0.3 mm. A flame, produced by a flow of propane of 2.5 l/min for each nozzle has been completely spread for an air flow greater than 40 l/min. The power developed by each flame was of the order of 4.2 kw.

Figure 5:
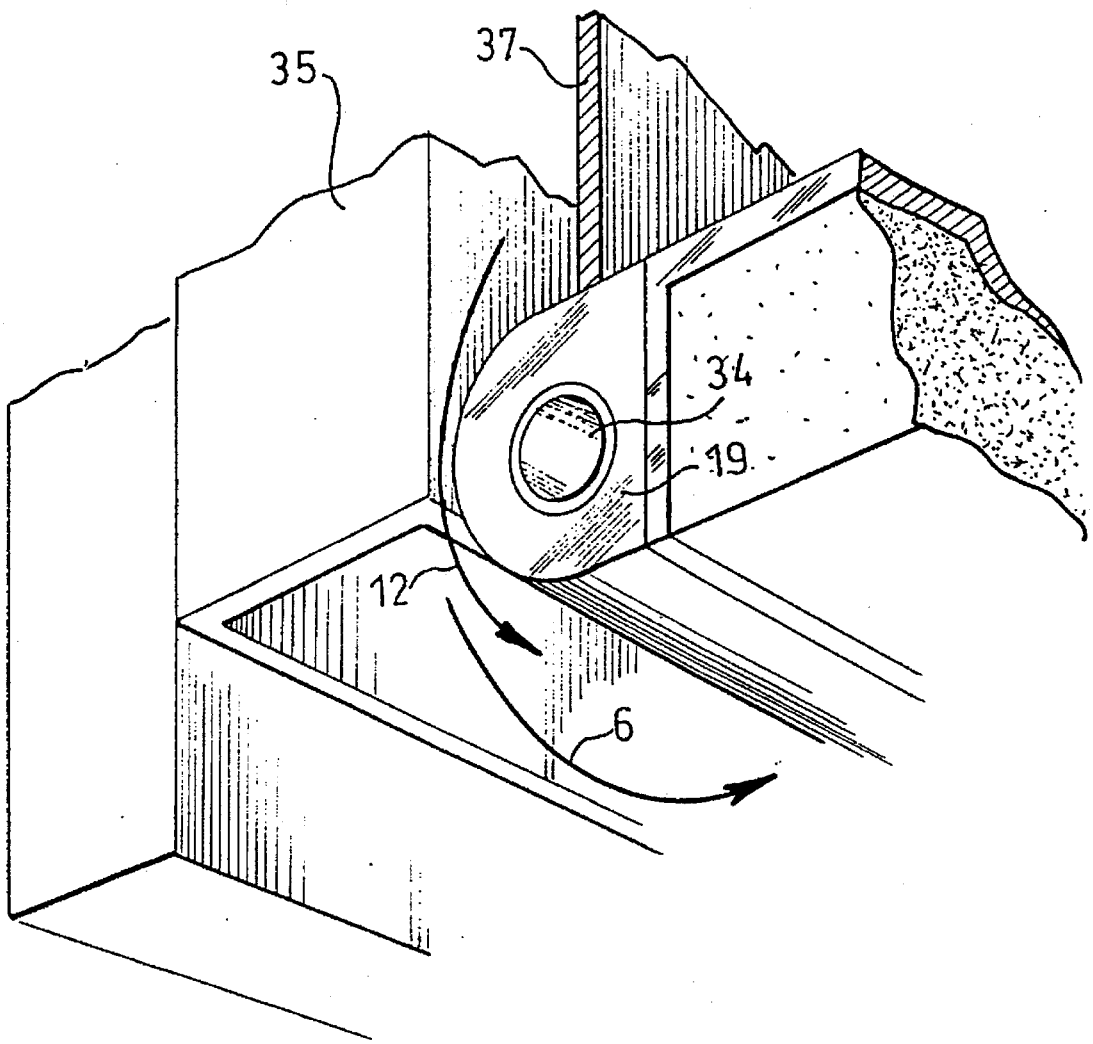
FIG. 5 is a perspective view of a device for spreading flame according to the invention, comprising principal and secondary nozzles of rectangular cross section with a single secondary jet.

There is shown in FIG. 5 a modified embodiment of the heating means for an oven according to the invention.

Whereas in FIG. 4 the principal nozzle and the secondary nozzle had a circular cross section, in the case of the embodiment of FIG. 5 the principal nozzle is constituted by a compartment 35 of elongated rectangular cross section.

A plate 37 delimits with the wall of compartment 35 which faces it, a space which permits supplying the secondary gas, whether combustible gas or combustion supporting gas.

The member 9, instead of having a toric shape, is of elongated rectangular shape. It delimits a slot which extends parallel to the length of the furnace. The operation of this device is identical. Its advantage resides in the fact that it permits obtaining a flame of great width, for example a flame which occupies the greatest portion of the length of the furnace. This permits obtaining a better distribution of the heat along the length of the furnace than a series of spaced heating nozzles.

Figure 6:
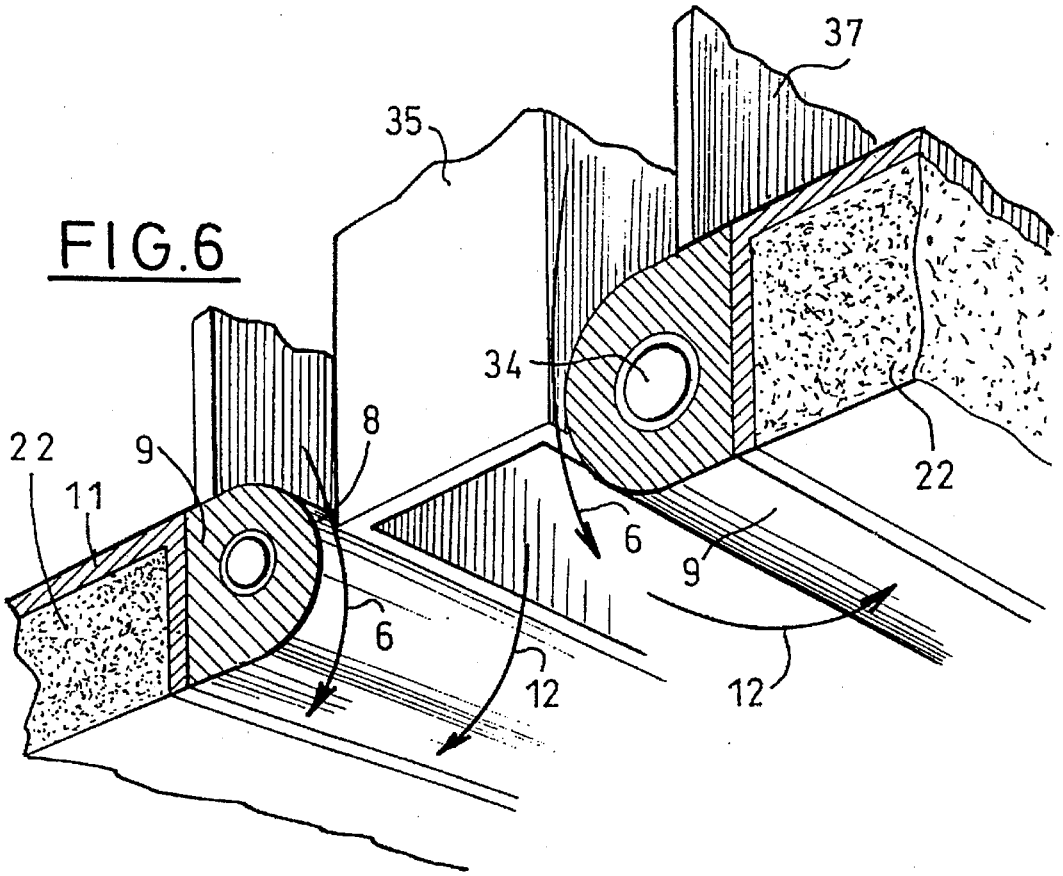
FIG. 6 is a perspective view of a device identical to that of FIG. 5, but comprising two secondary jets.

There is shown in FIG. 6 a modified embodiment of the device of FIG. 5. This modification is distinguished by the fact that a secondary jet is provided for each of the large sides of the compartment 35.

Figure 7:
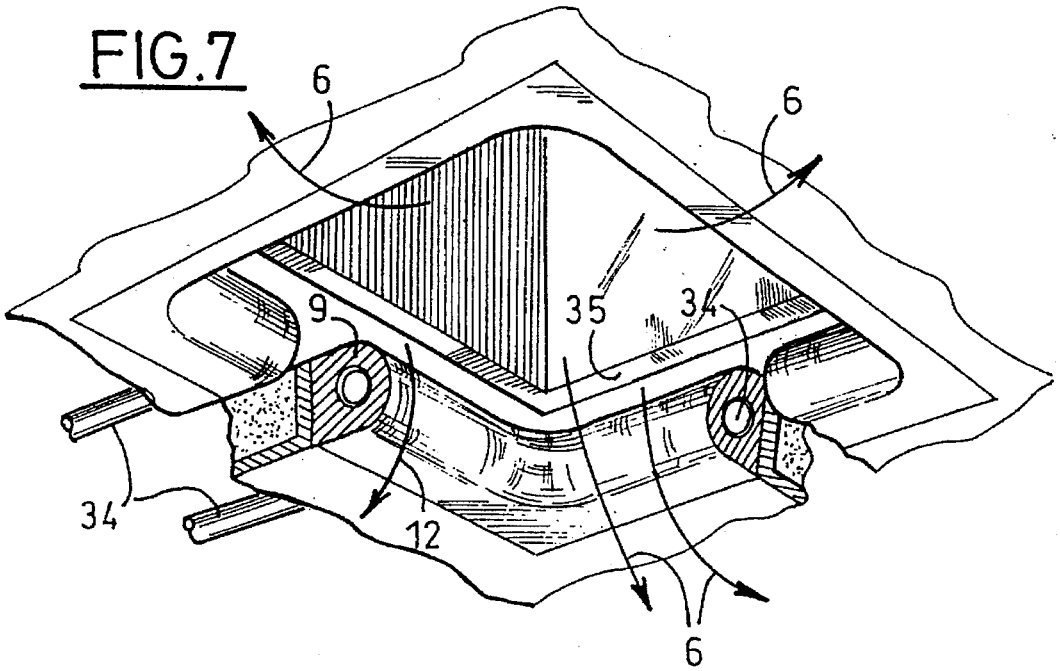
FIG. 7 is a perspective view of a flame-spreading device according to the invention, comprising a principal nozzle of square cross section.

Finally, there is shown in FIG. 7 a third modification of embodiment of this device. A principal nozzle 35 comprises a square section and the member 9 also has a square section which is rounded at its four corners. This modification permits obtaining four flames, namely one flame per side. It follows that a large number of other shapes could be imagined.

Figure 2:
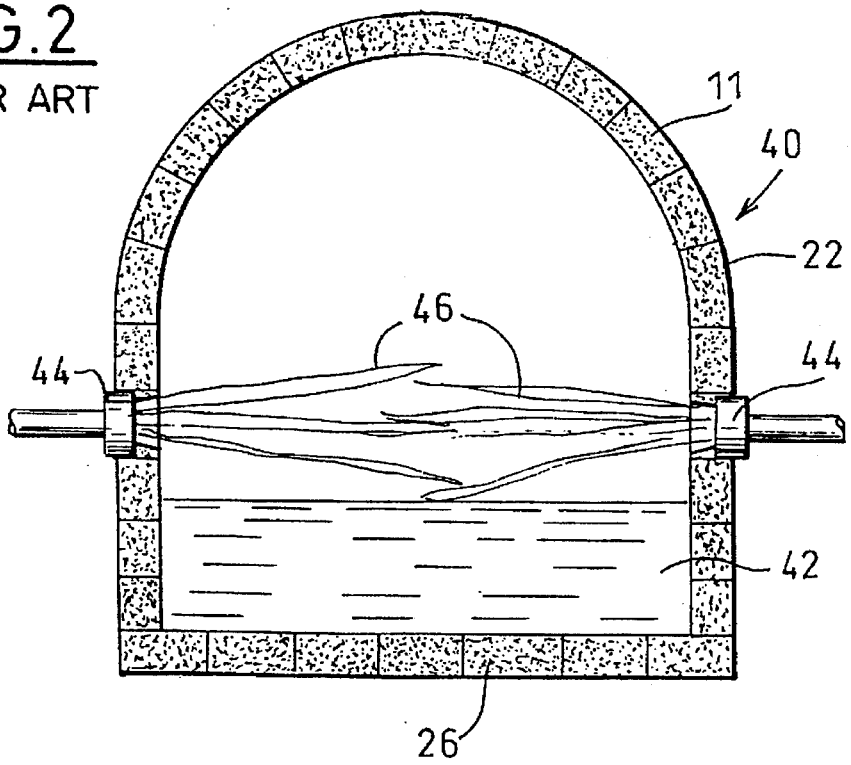
FIG.2 PRIOR ART
FIG. 2 is a cross-sectional view of another furnace of known type.

There is shown in FIG. 2 a second type of furnace of the prior art, designated by reference numeral 40. It comprises walls formed of refractory bricks 22. This furnace contains a charge 42. Heating nozzles 44 are provided on each side of the furnace 40.

It is desired that the flames 46 produced by the nozzles 44 be parallel to the level of the charge 42 so as to heat it regularly. Moreover, it is known that the flames 46 release hydroxyl radicals which oxidize the charge 42 when they are too close. A thin flame, whose distance to the surface of the bath is constant, permits avoiding this drawback.

Figure 8:
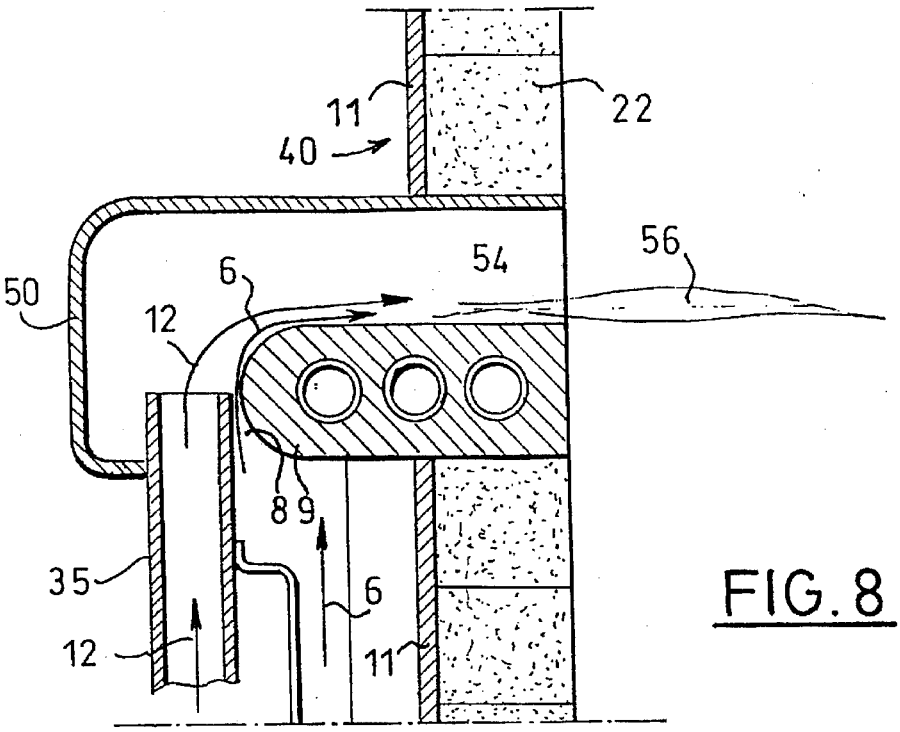
FIG. 8 is a fragmentary cross-sectional view of one embodiment of an oven according to the invention.

FIG. 8 shows in vertical cross-sectional view heating means for a furnace according to the present invention. These heating means comprise a compartment 35 of elongated rectangular cross section identical to the compartments shown in FIGS. 5 and 6. A sheet steel casing 50 connects an external wall of the compartment 35 to the wall of the furnace. A supply conduit 52 transports a secondary gas 12 to the secondary nozzle constituted by a slot of small width provided between one external wall of the compartment 35 and the curved surface of the member 9. The principal jet 6 and the secondary jet 12 mix and follow the wall of the member 9. There will also be noted the presence of channels adapted for the facultative circulation of a cooling fluid such as water.

The member 9 ends in a horizontal surface 54 perpendicular to the vertical wall 22 of the furnace. Correspondingly, the flame 56 detaches from the member 9 and enters the furnace horizontally, which is to say parallel to the surface of the glass bath 42.

Moreover, it has been established that the flame 56 does not flair and remains thin, even at a relatively great distance from the wall 22 of the furnace. This characteristic is particularly interesting because the flame can thus be arranged such that it will be relatively close to the surface of the charge without, however, touching it.

Figure 9:
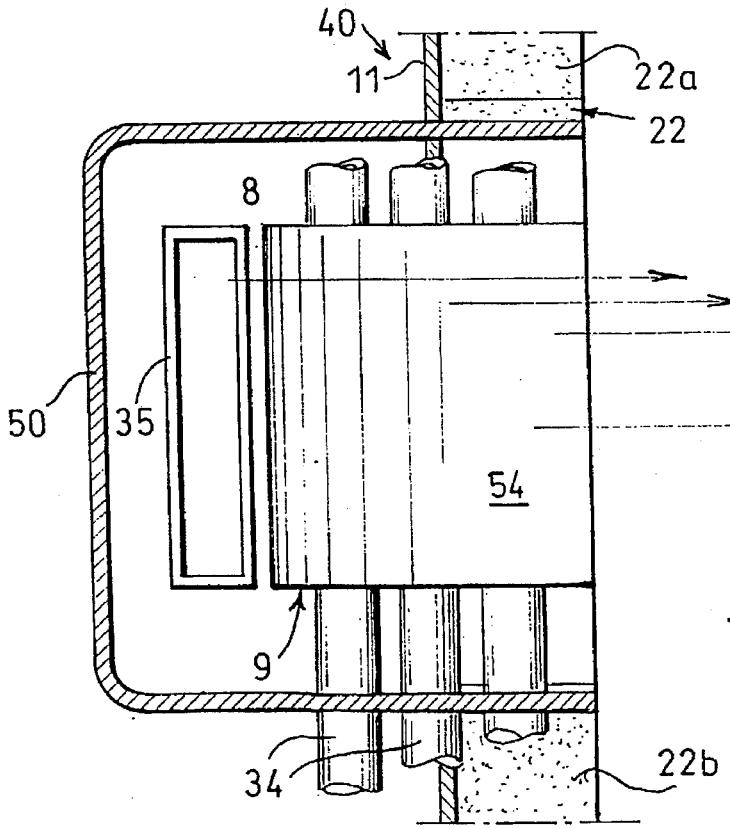
FIG. 9 is a fragmentary cross-sectional view of another embodiment of an oven according to the invention.

There is shown in FIG. 9 a third embodiment of a heating device for a furnace. There will be seen the external sheet metal wall 11 of the furnace and the refractory bricks 22 which line this wall. The heating means are identical to those which have been described with reference to FIG. 8, but the arrangement of the member 9 is different.

Reference numeral 22*a* designates the upper portion of the furnace and 22*b* the lower portion of this furnace. It will therefore be seen that the flat surface of the member 9 is disposed in a vertical plane instead of a horizontal plane, in FIG. 8. The outlet section of the compartment 35 constituting the principal nozzle is also arranged in a vertical plane. Correspondingly, the thin flame 56 also is. A device such as that shown in FIG. 9 can be used in a furnace of the type shown in FIG. 2.

However the height of the member 9 must not be very great. Thus, it is desirable that the flame 56 remain relatively near the free surface of the glass bath 42. This is the reason that a series of heating devices identical to that which is shown in FIG. 9 is used, according to the length of the furnace, so as to heat the charge.

We claim:

1. A device for spreading a flame, comprising means forming at least one principal nozzle delivering a jet of combustible gas or combustion supporting gas, means forming at least one secondary nozzle delivering a jet of combustion supporting gas or combustible gas which flows next to the principal jet and which has a substantially constant width, said means forming said at least one secondary nozzle including at least one curved surface disposed tangentially to the secondary jet of gas so as to deflect it by the Coanda effect, to draw in the principal jet of gas and to mix the secondary jet and the principal jet to form a flame, a cross-section of the curved surface having a center of curvature that lies in a common plane with a discharge end of said means forming at least one principal nozzle.

2. A device according to claim 1, wherein the principal nozzle has a circular cross section, and the secondary nozzle, of annular section, surrounds the principal nozzle.

3. A device according to claim 1, wherein the principal nozzle has a cross section of rectangular shape, said at least one secondary nozzle delivering a secondary jet tangential to one of the sides of the rectangle formed by the principal nozzle.

4. A device according to claim 1, wherein the principal nozzle has a cross section of polygonal shape.

5. A device according to claim 1, wherein the combustible gas is methane or propane.

6. A device according to claim 1, wherein the combustion supporting gas is oxygen or air.

7. A furnace comprising walls delimiting a chamber and heating means, the heating means being constituted by a device for spreading flame according to claim 1.

8. A furnace according to claim 7, wherein the principal jet is substantially perpendicular to one wall of the furnace and the curved surface deflects the jet substantially by 90° such that the flame flows tangentially to a wall of the furnace.

9. A furnace according to claim 7, wherein the curved surface ends in a surface substantially perpendicular to a wall of the furnace so as to obtain a flame perpendicular to this wall.

10. A furnace according to claim 9, wherein the region substantially perpendicular to one wall of the furnace is disposed horizontally.

11. A furnace according to claim 9, wherein the region substantially perpendicular to one wall of the furnace is disposed vertically.

* * * * *